United States Patent [19]

Tsutsui et al.

[11] Patent Number: 5,058,562

[45] Date of Patent: Oct. 22, 1991

[54] ROTARY DIAMOND TOOL FOR TRUING GRINDING WHEEL

[75] Inventors: Toshihiro Tsutsui, Nishio; Shinji Soma, Handa, both of Japan

[73] Assignee: Toyoda Koki Kabushiki Kaisha, Kariya, Japan

[21] Appl. No.: 554,862

[22] Filed: Jul. 20, 1990

[30] Foreign Application Priority Data

Jul. 28, 1989 [JP] Japan ..... 1-197865

[51] Int. Cl.[5] ..... B24B 53/14

[52] U.S. Cl. ..... 125/11.03; 51/207; 51/295; 51/297; 76/DIG. 6; 76/101.1; 76/DIG. 12

[58] Field of Search ..... 125/11.03; 51/206 R, 51/206 NF, 207, 209 R, 295, 297, 204 R; 76/DIG. 6, DIG. 12, 101.1

[56] References Cited

U.S. PATENT DOCUMENTS 4,884,476 12/1989 Okuzumi et al. ..... 76/DIG. 12

FOREIGN PATENT DOCUMENTS 0116668 8/1984 European Pat. Off. ..... 125/11.03
2834149 2/1980 Fed. of Germany .
3811784 7/1989 Fed. of Germany .
552180 11/1956 Italy .
0037057 2/1984 Japan ..... 51/295
0218071 9/1987 Japan ..... 51/295
3267166 11/1988 Japan ..... 51/295

*Primary Examiner*—Robert A. Rose
*Attorney, Agent, or Firm*—Oblon, Spivak, McClelland, Maier & Neustadt

[57] ABSTRACT

A rotary diamond tool for truing a grinding wheel, comprising one or two circular vapor-deposited base plates each having a thin diamond layer formed by a vapor deposition process such as electron assisted chemical vapor deposition or direct current plasma chemical vapor deposition. The diamond truing tool is further provided with a pair of backup plates brazed on both side surfaces of the one or two circular vapor-deposited base plates so that the stiffness of the diamond truing tool is increased.

6 Claims, 4 Drawing Sheets

ROTARY DIAMOND TOOL FOR TRUING GRINDING WHEEL

BACKGROUND OF THE INVENTION

1. Field of the Invention

The present invention relates to a rotary diamond tool suitable for truing a grinding wheel made of hard abrasive grains such as cubic boron nitride, diamond or the like.

2. Discussion of the Prior Art

In the past, a single-point type diamond tool 7 shown in FIG. 7 was widely used for truing a grinding wheel. The diamond truing tool was composed of a base 71 made of steel and a single diamond 72 which is partially buried in the front end of the base 71.

The single-point type diamond tool 7 is capable of truing a grinding surface of a grinding wheel with an appropriate surface roughness, thereby reducing the grinding resistance of the grinding wheel. The diamond tool 7, however, has a disadvantage that the life time thereof is relatively short, because the top tip of the diamond 72 wears rapidly and it is difficult to keep the sharpness of the diamond 72. Therefore, the diamond tool 7 cannot be used in an automated truing apparatus in which the diamond truing tool is required to have a long life. Further, the diamond tool 7 has another disadvantage that the truing ability is instable, because it has an anisotropic of hardness due to the crystal orientation. Namely, the hardness of the diamond changes depending upon the direction of force applied to the diamond.

Also, a diamond truing tool 8 shown in FIG. 8 has been used for truing a grinding wheel. The diamond truing tool 8 is a metal-bonded grinding wheel containing a lot of diamond abrasive grains 81 which are united each other with binding agent 82 such as nickel by a powder metallurgy process. The diamond truing tool 8 is formed in a thin cylindrical shape, and held by a pair of mounting flanges 21 through which the diamond truing tool 8 is attached to the rotary spindle of a truing device (not shown) using a nut.

Although the diamond truing tool 8 has an advantage of long life, the diamond truing tool 8 has a disadvantage that it is difficult to form sharp cutting edges on the periphery surface thereof, and therefore difficult to reduce the grinding resistance of a grinding wheel to a sufficient level by a truing operation. Also, the diamond truing tool 8 has another disadvantage that the stiffness thereof is not sufficient, because the thickness thereof is small. Therefore, the periphery cutting portion of the tool 8 tends to vibrate, resulting in positional changes of the cutting portion during truing operations. Further, when the diamond truing tool 8 is used, the amount of cut-in feed during the truing operation is limited within a predetermined range corresponding to the stiffness of the tool 8. Therefore, the truing efficiency cannot be increased so much.

SUMMARY OF THE INVENTION

Accordingly, it is a primary object of the present invention to provide an improved rotary diamond tool having a sufficient stiffness and a stable truing ability.

Briefly, the present invention provides a rotary diamond tool for truing a grinding wheel, comprising a circular base portion provided with a diamond layer formed by vapor deposition and extending in a plane perpendicular to a rotational axis of the circular base portion. The rotary diamond tool is further provided with a pair of circular plates made of metal having a hardness lower than that of said circular base portion, which are united with the side surfaces of said circular base portion, respectively.

With this configuration, the diamond truing tool always has a sharp cutting portion, and has a high wearability. Moreover, since the diamond layer does not have anisotropic of hardness due to the crystal orientation, the periphery of the truing tool has a stable truing capability.

Further, the diamond truing tool according to the present invention have a high stiffness, preventing vibrations of the tool at its periphery portion.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENT

Figure 2:
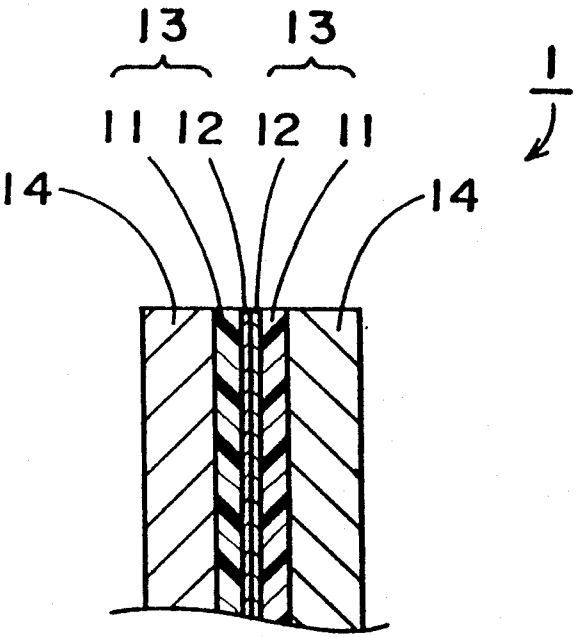
FIG. 2 is an enlarged fragmentary sectional view showing a peripheral portion of the diamond truing tool shown in FIG. 1.
Figure 1:
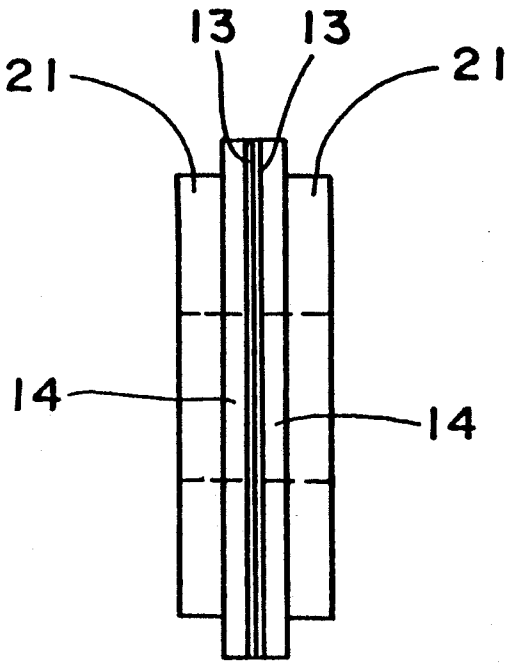
FIG. 1 is an outside view showing a diamond truing tool according to a first embodiment of the present invention.

Referring now to the drawings and particularly, to FIGS. 1 and 2 thereof, the diamond truing tool 1 is composed of a pair of circular vapor-deposited base plates 13 and a pair of circular backup plates 14, and is united with a pair of mounting flanges 21, 21 using plural bolts (not shown). The diamond truing tool 1 held by the mounting flanges 21, 21 is attached to the rotary spindle of a truing apparatus (not shown) using a nut, and is rotated by a motor for truing a grinding wheel made of hard abrasive grains such as cubic boron nitride, diamond or the like.

Each of the vapor-deposited base plate 13 is composed of a circular base plate 11 which is made of tungsten carbide, silicon, silicon carbide or similar material. The circular base plate 11 has a diamond layer which is vapor-deposited on one of side surfaces of the base plate 11 so as to constitute the vapor-deposited plate 13. The backup plates 14 are made of soft material, such as steel, having the same diameter as that of the base plate and a lower hardness as compared with the base plate 11.

The above-described diamond truing tool is constructed as follows.

Figure 4:
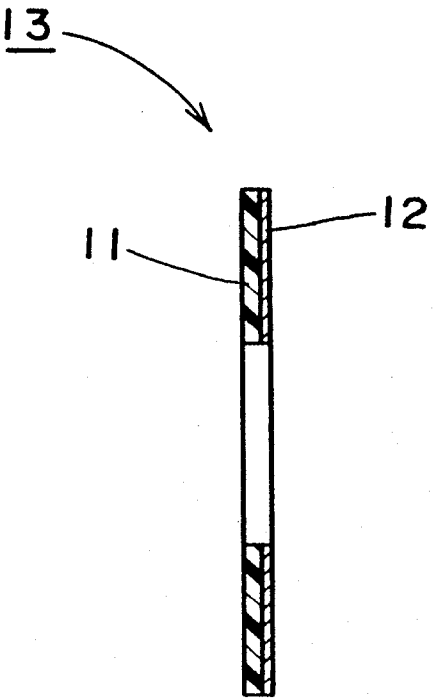
FIG. 4 is a sectional view taken along the line IV—IV of FIG. 3.
Figure 3:
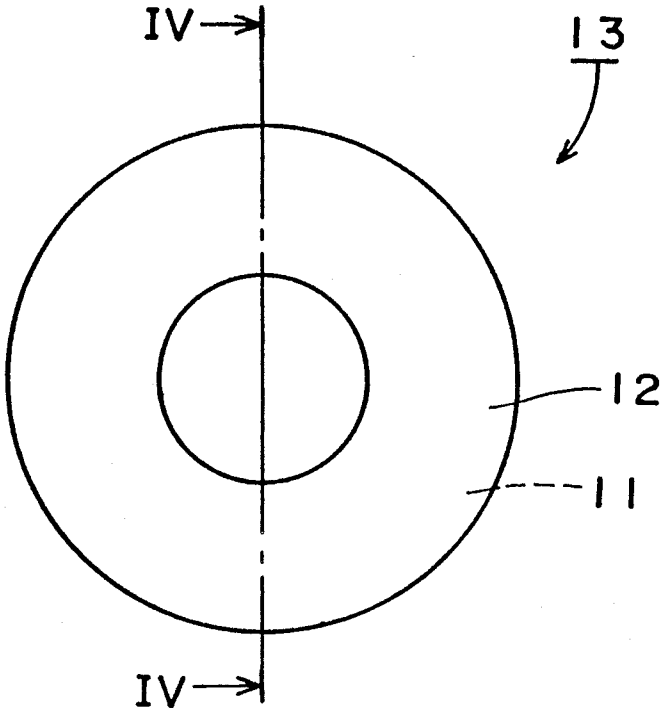
FIG. 3 is a front view showing a base plate on which a diamond layer is deposited.

FIG. 3 is a front view of the vapor-deposited base plate 13 and FIG. 4 is a sectional view taken along the line IV—IV of FIG. 3. At first, a layer or film of diamond is deposited on one of side surfaces of each base plate 11 by a vapor growth process so as to constitute the vapor-deposited base plate 13. EACVD (Electron Assisted Chemical Vapor Deposition) and DC plasma CVD (Chemical Vapor Deposition) can be used for depositing the diamond layer 12. In the EACVD, electrons emitted from heated filament is accelerated to resolve raw material gas such as $H_2$, $CH_4$ so that the diamond layer 12 is deposited on the base plate 11. By the EACVD process, a diamond layer having a thickness of 5 through 10 μm can be formed on the base plate 11. In the DC plasma CVD, the diamond layer 12 is separately formed by a direct-current plasma, and is then brazed on the base plate 11. By the DC plasma CVD process, a diamond layer having a thickness of 50 through 100 μm can be formed on the base plate 11.

After the preparation of the vapor-deposited base plates 13, the pair of vapor-deposited base plates 13 are united each other by brazing in such a way that the diamond layer 12 of respective vapor-deposited base plates 13 face each other. As a result, both diamond layers 12 are interposed between the pair of the base plates 11, as shown in FIG. 2.

After that, the backup plates 14 are brazed to outside side surfaces of the base plates 11 so as to constitute the diamond truing tool 1 , as shown in FIGS. 1 and 2.

In the diamond truing tool 1 constructed as above, the pair of vapor-deposited base plates 13 are backed up by the pair of backup plates 14 from both sides thereof so that the stiffness of the tool 1 is increased. As a result, the outer periphery of the tool 1 is prevented from vibrating during truing operations, improving the stability of truing operations. It is to be noted that the base plates 11 and the backup plates 14 are ground when the diamond layer 12 is worn in the radial direction during the truing operations.

Figure 5:
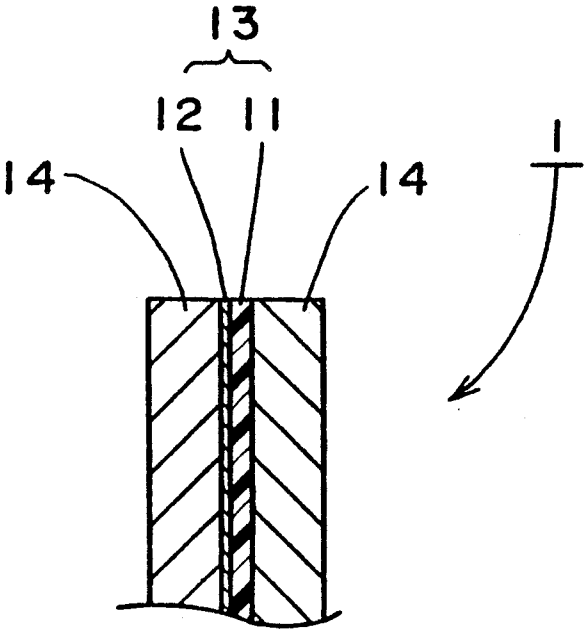
FIG. 5 is an enlarged fragmentary sectional view showing a peripheral portion of a diamond truing tool according to a second embodiment of the present invention.
Figure 8:
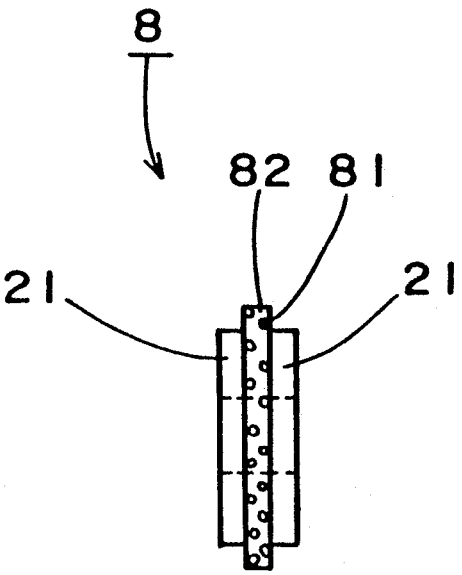
FIG. 8 PRIOR ART
FIG. 8 is a front view showing a prior art metal-bonded grinding wheel used as diamond truing tool.
Figure 7:
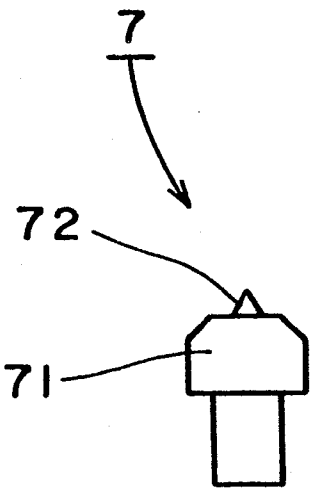
FIG. 7 PRIOR ART
FIG. 7 is a front view showing a prior art diamond truing tool with single diamond.

A second embodiment of the present invention will now be explained with reference to FIG. 5. In the second embodiment, single vapor-deposited base plate 13 is used, and a pair of backup plates 14 are brazed on the diamond layer 12 and the back surface of the base plate 11, respectively.

Figure 6:
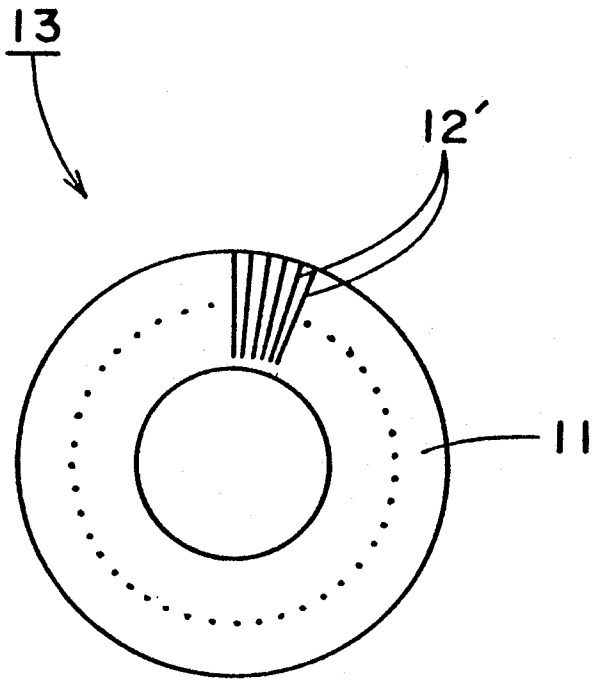
FIG. 6 is a front view showing a base plate on which a diamond layer is deposited according to a third embodiment of the present invention.

Further, FIG. 6 shows a third embodiment of the present invention, in which a plural diamond layer elements 12' are vapor-deposited on the base plate 11. Each diamond layer element 12' has a narrow width in the circumferential direction and extends in radial directions. With this configuration, the diamond layer elements 12' are intermittently contacted at their outer portions with a grinding wheel so that the abrasive grains and binding agent of the grinding wheel are efficiently removed.

As described above, in the diamond truing tool according to the present invention, a diamond layer is formed on a base plate using a vapor growth process. Since the diamond layer formed by the vapor growth process is a fine-grained polycrystalline substance having a thin thickness, the diamond truing tool always has a sharp cutting portion and is capable of truing a grinding wheel with an appropriate surface roughness. Further, it has a high wearability, because the diamond layer does not include any binding agent such as nickel. Moreover, since the diamond layer dose not have anisotropic of hardness due to the crystal orientation, i.e., the hardness does not change depending upon the direction of force applied to the periphery of the diamond layer, the periphery of the truing tool has a stable truing capability.

Since backup plates are brazed on both side of the base plate, the diamond truing tool according to the present invention have a high stiffness, preventing vibration of the tool at its periphery portion, deformation, and damage thereof. Accordingly, the truing efficiency can be improved by increasing the amount of cut-in feed during truing operations.

Obviously, numerous modifications and variations of the present invention are possible in light of the above teachings. It is therefore to be understood that within the scope of the appended claims, the present invention may be practiced otherwise than as specifically described herein.

What is claimed is:

1. A rotary diamond tool for truing a grinding wheel, comprising:

a circular base portion comprising a pair of base plates each of which has a vapor-deposited diamond layer formed on a first side surface thereof, said diamond layers extending in a plane perpendicular to a rotational axis of said circular base portion, wherein said pair of base plates are united with each other in such a way that diamond layers of respective vapor-deposited base plates face each other; and a pair of circular plates made of metal having a hardness lower than that of said circular base portion, said pair of circular plates being united with a second side surface of each of said pair of base plates, respectively.

2. A rotary diamond tool as set forth in claim 1, wherein said diamond layer formed on respective vapor-deposited base plates is a single continuous circular diamond layer which is formed by a chemical vapor deposition process and extends within the side surface of said base plate.

3. A rotary diamond tool as set forth in claim 1, wherein said diamond layer is composed of plural diamond layer elements, each diamond layer element being formed by a chemical vapor deposition process and having a predetermined width in a circumferential direction.

4. A rotary diamond tool for truing a grinding wheel, comprising:

a circular base portion comprising a single vapor-deposited base plate having a diamond layer deposited on a first side surface thereof, wherein said diamond layer extends in a plane perpendicular to a rotational axis of said circular base portion; and a pair of circular plates made of metal having a hardness lower than that of said circular base portion, said pair of circular plates being united with said diamond layer and a second side surface of said circular base portion, respectively.

5. A rotary diamond tool as set forth in claim 4, wherein said diamond layer is a single continuous circular layer which is formed by a chemical vapor deposition process and extends within the side surface of said base plate.

6. A rotary diamond tool as set forth in claim 4, wherein said diamond layer is composed of plural diamond layer elements, each diamond layer element being formed by a chemical vapor deposition process and having a predetermined width in a circumferential direction.

* * * * *